United States Patent [19]

Ishida

[11] 4,177,402

[45] Dec. 4, 1979

[54] MAGNETRON POLE PIECE ASSEMBLY

[75] Inventor: Yoshio Ishida, Mobara, Japan

[73] Assignee: Hitachi, Ltd., Tokyo, Japan

[21] Appl. No.: 880,587

[22] Filed: Feb. 23, 1978

[30] Foreign Application Priority Data

Jun. 24, 1977 [JP] Japan ..... 52-82497[U]

[51] Int. Cl.[2] ..... H01J 25/50

[52] U.S. Cl. ..... 315/39.71; 315/39.51; 315/39.75

[58] Field of Search ..... 315/39.71, 39.75, 39.51, 315/39.53

[56] References Cited

U.S. PATENT DOCUMENTS

| | | | |
|---|---|---|---|
| 3,543,082 | 11/1970 | Boehm | 315/39.71 X |
| 3,987,333 | 10/1976 | Nakada et al. | 315/39.71 |
| 4,027,194 | 5/1977 | Yamano | 315/39.71 |
| 4,048,542 | 9/1977 | Miura | 315/39.71 |
| 4,075,534 | 2/1978 | Saito et al. | 315/39.71 |

*Primary Examiner*—Saxfield Chatmon, Jr.
*Attorney, Agent, or Firm*—Charles E. Pfund

[57] ABSTRACT

A magnetron having permanent magnets sealed in the vacuum container, in which the permanent magnets and pole pieces associated therewith are supported with the inner wall of the vacuum container and holders provided thereon, and the pole pieces are projecting through the openings of holders into the interaction spaces which are defined between vanes in the vacuum container and a cathode, and the projecting portion of the pole piece is fixed to the opening of the holder by means of arc-welding or silver-alloy brazing.

6 Claims, 2 Drawing Figures

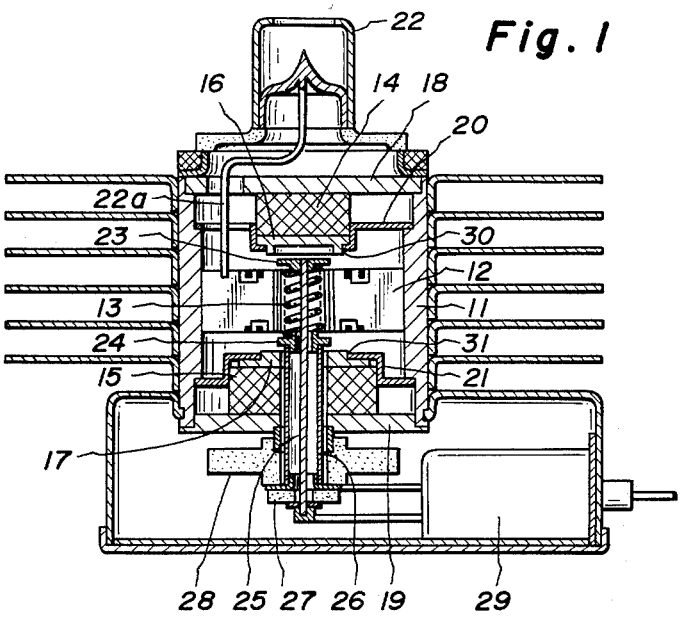
Fig. 1
Fig. 2
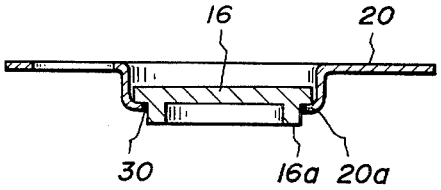

MAGNETRON POLE PIECE ASSEMBLY

BACKGROUND OF THE INVENTION

This invention relates to a magnetron, more particularly to the magnetron having permanent magnets which are disposed in the vacuum container.

An inner sealed magnet type magnetron of this class may be seen in FIG. 2 of the papers entitled "A Hitachi New Magnetron with an Inserted Magnetic Circuit", which was prepared and reported by Ichiro Inamura et al at International Microwave Power Institute Symposium of May 26, 1977. In this magnetron, the permanent magnet may be disposed more closely to the interaction space which is defined between the cathode and vanes, so that the leakage of magnetic flux in the magnetic circuit becomes smaller and the magnetic flux generated from permanent magnets may be effectively made use of. Thus, a smaller permanent magnet may comply with requirement for magnetron use, and this contributes to lessening the entire dimension of the magnetron. For this reason, the magnetron disclosed in the above papers is now establishing a good reputation.

It is well known, however, that in response to the change of magnetic flux the inner wall of the outer casing which contains the vacuum space or the parts which are disposed therein allows an electric current to flow through their surface. Accordingly, if there is an imperfect connection between the parts contained in the vacuum space, an electric field would be concentrated on such imperfect connecting portion and it would cause a spark discharge eventually. In the magnetron as mentioned above, such sparking phenomenon is apt to be observed at the portion between the pole piece and the holder which is supported by the inner wall of an anode cylinder constituting a part of the outer casing. This depends on the following. The parts other than the holder and the pole piece may be processed and manufactured with comparactively high accuracy whereas the holder and the pole piece may be not. Generally, these two parts, the holder and pole piece, are manufactured through press work in view of their manufacturing cost. Further, the holder is made by using a metal plate having the thickness of from 0.2 to 0.5 mm in consideration of its strength. Consequently, some warps due to the press work occur at certain portions of the holder, for example at the opening to receive the pole piece projecting therethrough into the interaction space or at the opening for the output antenna. What is worse, such warps are apt to concentrate on the peripheral portion of the opening with which the pole piece is going to contact. Thanks to these warps introduced, it becomes very hard to obtain a contact between the holder and the pole piece in such a preferable mode that both parts entirely and uniformly contact to each other or that both parts contact to each other through contacting points which are uniformly distributed along the circumference of a coaxial circle about the opening. Imperfect contact, especially the contact which is extremely localized due to the warp, is helpful for causing the spark discharge phenomenon. Especially, where small quantity of food is cooked in an electronic oven including the magnetron, a large amount of reflected microwave is returned from the antenna so that the electric field at the above-mentioned imperfect contacting point is extremely enhanced thereby the intensive spark discharge being initiated to melt materials locally at such point eventually. As a consequence, gas is discharged to destroy a heated cathode filament. Where the pole piece is melted, it is deformed so that magnetric field distribution becomes worse thus inviting destruction of the magnetron. Further, when the spark discharge is initiated, the heat generated thereby elevates the temperature of the permanent magnet up to more than 300° C. by the help of thermal conduction. In general, the permanent magnet for magnetron use is made of rare earth elements of samarium.cobalt system. When the permanent material made of such material is heated at the temperature of more than 300° C., magnetism is permanently faded away, thus the magnetron being made inoperative. The above discussion has been proceeded in connection with the output side of the magnetron. However, same discussion is possible as to the magnet and holder in the input side of the magnetron.

SUMMARY OF THE INVENTION

Accordingly, a main object of the present invention is to provide an improved magnetron in which difficult problem experienced thus far, such as spark discharge phenomenon caused by microwave surface current flowing on the surface of the inner wall of the outer casing which is forming the vacuum space or on the surface of the parts disposed in such vacuum space, such as material melting caused by the spark, such as degradation of filament characteristics due to gas discharge and so forth, may be solved at once.

According to the present invention, there is provided a magnetron comprising an outer casing which includes an anode cylinder and yokes disposed at both ends of said cylinder and forming a vacuum space, a plurality of vanes extending from the inner wall of said anode cylinder in the centripetal direction, a cathode structure disposed so as to form an interaction space between itself and said vanes, a holder fixed on the inner wall of said anode cylinder, a pole piece and a magnet disposed between said holder and one of said yokes, characterized in that through the opening formed at the center of the holder the pole piece is made to project into the interaction space and is fixed at the periphery of the opening.

According to to the present invention, there is still provided a magnetron comprising an outer casing which includes an anode cylinder and yokes disposed at both ends of said cylinder and forming a vacuum space, a plurality of vanes extending from the inner wall of the anode cylinder in the centripetal direction, a cathode structure disposed so as to form an interaction space between itself and said vanes, two holders fixed on the inner wall of said anode cylinder at both sides of said vanes, and pole pieces and magnets, disposed between respective holders and yokes, characterized in that pole pieces projecting into the interaction space through the openings provided at the center of said two holders are fixed at peripheries of said openings respectively.

BRIEF DESCRIPTION OF THE DRAWING

In the accompanying drawings,

FIG. 1 is a longitudinal cross sectional view of the magnetron embodying the present invention.

FIG. 2 is a sectional diagrammatical representation for showing connection between the pole piece and the holder for supporting the holder and pole piece.

PREFERRED EMBODIMENT OF THE PRESENT INVENTION

FIG. 1 shows one example of a magnetron embodying the present invention. In the figure, a reference numeral 11 designates an anode cylinder having a plurality of vanes 12 which are centripetally extending from the inner wall of the anode cylinder. This cylinder and yokes (described later) makes an outer casing so as to form a vacuum space. A reference numeral 13 represents a filament which is a part of a cathode structure and is adapted to emit thermal electrons. Permanent magnets 14 and 15 are inserted and sealed in the vacuum space. Pole pieces 16 and 17 are made to contact with respective one sides of the magnets 14 and 15. They are adapted to guide the magnetic flux to the interaction space between the vanes 12 and the filament 13 as well as to realize a uniform distribution of the magnetic flux. Yokes 18 and 19 form a part of the outer casing as well as the anode cylinder 11 does. Holders 20 and 21 are made of a non-magnetic material and are adapted to firmly support a group of the pole piece 16 and the magnet 14 and another group of the pole piece 17 and the magnet 15. An output antenna is designated by a reference numeral 22. End shields 23 and 24 are constituting a part of the cathode structure and are used for preventing thermal electrons emitted by the filament from being dispersed. One end of the filament 13 is supported by a center lead 25 through the end shield 23 whereas the other end of the filament 13 is supported by a heat dam 26 through the end shield 24. The heat dam 26 is the path for the filament current as well as the center lead 25 is. These center lead 25 and heat dam 26 are supported by a stem 27 which is silver-soldered on the yoke 19 through a ceramic plate 28. A reference numeral 29 stands for a filter, through which a high tension is supplied. This filter is also adapted to prevent unnecessary microwave leakage from the power source lines.

In the magnetron as constructed above, the magnets 14 and 15, and the pole pieces 16 and 17 are firmly fixed on yoke 18 or 19 by resilient force of holder 20 or 21.

Further, in the magnetron according to the present invention, holders 20 and 21, and pole pieces 16 and 17 are welded or silver-soldered to each other to realize firm contact therebetween. Take the embodiment in FIG. 2 for example. The opening **20*a* of the holder 20 receives the annular projection 16*a* provided on the pole piece 16 (the depressed center portion is formed to let the magnetic field in the interaction space be uniform), and then the side wall of the opening 20*a* and the outer wall of said annular projection 16*a* facing thereto are firmly connected by means of arc-welding or silver-alloy brazing. Processed point is represented by a reference numeral 30**. It should be noted that welding over the entire circumference of the annular projection is not always necessary. Spaced spot weldings provides a good result but spacing between welding points should be uniform and less than 60° in terms of the center angle. For example, in case the microwave output of the magnetron is 2455 MHz, no microwave current is observed when the spacing is set about 4 mm, but leakage current is initiated when the spacing is more than that value. Accordingly spacing of welding points should be determined referring to the frequency to be used.

In the example shown in FIG. 1, welding or silver-soldering 31 is performed between the holder 21 and the pole piece 17.

As discussed above, according to the present invention, the contact between the holder and pole piece is firmly realized along the entire circumference of the pole piece. Consequently, when the microwave surface current even flows through the surfaces of the holder and pole piece during use of the magnetron, difficult problems, such as sparking, material melting, gas discharging or permanent fading of magnetism in the magnet as previously described, are avoided thereby accidents being prevented.

What is claimed is:

1. In a magnetron comprising an outer casing which includes an anode cylinder and yokes disposed at the both ends of said anode cylinder and is adapted to form a vacuum space, a plurality of vanes centripetally extending from the inner wall of said anode cylinder, a cathode structure disposed so as to form an interaction space between itself and said vanes, a holder located within said vacuum space which is firmly fixed on the inner wall of said anode cylinder and which has an opening formed in the center thereof, and a pole piece and a magnet disposed between said holder and one of said yokes, the improvement wherein through the opening formed at the center of said holder said pole piece is made to project into said interaction space and is metallically bonded to said holder at the periphery of said opening.

2. A magnetron according to claim 1, wherein the pole piece is bonded to the holder by arc welding.

3. A magnetron according to claim 1, wherein the pole piece is bonded to the holder by silver-alloy brazing.

4. In a magnetron comprising an outer casing which includes an anode cylinder and yokes disposed at the both ends of said cylinder and is adapted to form a vacuum space, a plurality of vanes centripetally extending from the inner wall of said anode cylinder, a cathode structure disposed so as to form an interaction space between itself and said vanes, two holders located within said vacuum space firmly fixed on the inner wall of said anode cylinder on the both sides of said vanes and which each have openings provided at the centers thereof, and pole pieces and magnets disposed between respective holders and yokes, the improvement wherein through the openings provided at each center of said two holders respective pole pieces are made to project into the interaction space and are metallically bonded to said holders at each periphery of said openings respectively.

5. A magnetron according to claim 4 wherein the pole pieces are bonded to the holders by arc-welding.

6. A magnetron according to claim 4 wherein the pole pieces are bonded to the holders by silver-alloy brazing.

* * * * *